US009469947B2

(12) United States Patent
Ries

(10) Patent No.: US 9,469,947 B2
(45) Date of Patent: Oct. 18, 2016

(54) MODULAR COMPACTOR FRAME CONSTRUCTION

(71) Applicant: Caterpillar Paving Products Inc., Brooklyn Park, MN (US)

(72) Inventor: Michael W. Ries, Coon Rapids, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 18 days.

(21) Appl. No.: 14/512,861

(22) Filed: Oct. 13, 2014

(65) Prior Publication Data

US 2016/0102437 A1 Apr. 14, 2016

(51) Int. Cl.

| | |
|---|---|
| ***E01C 19/26*** | (2006.01) |
| ***E01C 19/00*** | (2006.01) |
| ***E01C 19/23*** | (2006.01) |
| ***E01C 19/48*** | (2006.01) |

(52) U.S. Cl.

CPC ..... *E01C 19/264* (2013.01); *E01C 19/002* (2013.01); *E01C 19/236* (2013.01); *E01C 19/4866* (2013.01)

(58) Field of Classification Search

CPC ..... E01C 19/264; E01C 19/002; E01C 19/4866; E01C 19/286; E01C 19/38; E01C 19/236

See application file for complete search history.

(56) References Cited

U.S. PATENT DOCUMENTS

| | | | | |
|---|---|---|---|---|
| 1,320,533 | A | 11/1919 | Cull | |
| 2,943,541 | A * | 7/1960 | Dunn | E01C 19/27 404/122 |
| 3,146,686 | A | 9/1964 | Grace et al. | |
| 3,868,194 | A * | 2/1975 | Ferguson | E01C 19/26 180/20 |
| 4,260,280 | A | 4/1981 | Hirn et al. | |
| 4,676,545 | A * | 6/1987 | Bonfilio | B62D 21/00 114/357 |
| 4,854,772 | A * | 8/1989 | Sinkkonen | E02D 3/026 296/193.04 |
| 5,993,110 | A * | 11/1999 | Bueno | E02D 3/026 404/122 |
| 8,636,299 | B2 | 1/2014 | Lindholm | |
| 8,967,910 | B2 * | 3/2015 | Hansen | B06B 1/00 404/113 |
| 2012/0173091 | A1 * | 7/2012 | Hukkeri | B60W 40/068 701/50 |
| 2014/0133909 | A1 * | 5/2014 | Hansen | B06B 1/00 404/117 |

FOREIGN PATENT DOCUMENTS

| | | |
|---|---|---|
| WO | WO 99/49138 A1 | 9/1999 |

* cited by examiner

*Primary Examiner* — Abigail A Risic
(74) *Attorney, Agent, or Firm* — Leydig, Voit & Mayer, Ltd.; Andrew A. Phillips

(57) ABSTRACT

A modular compactor includes a frame assembly having a first motive section including at least one first wheel, a second motive section including at least one second wheel, and a central ballast section including ballast. The ballast provides weight to the frame assembly to provide a desired compacting force. A first coupling arrangement secures the first motive section to the central ballast section, and a second coupling arrangement secures the second motive section to the central ballast section.

9 Claims, 2 Drawing Sheets

MODULAR COMPACTOR FRAME CONSTRUCTION

TECHNICAL FIELD

This patent disclosure relates generally to compactors and, more particularly to a modular frame arrangement for compactors.

BACKGROUND

Compactors are typically used to compact material, such as hot asphalt, loose gravel, soil or other material. One type of compactor is a pneumatic compactor. Models of pneumatic compactors may include constructions that are specific to the particular application for which the machine will be utilized. While pneumatic compactors can be constructed in a variety of configurations, generally, compactors are vehicles including one or more cylindrically shaped wheels in the front and the back that compress material underneath.

Pneumatic compactors may work effectively on a wide range of applications. They are commonly utilized for applications such as wear courses and binder courses as well as compaction of natural soils and materials with lime or cement. For example, pneumatic compactors with rotating wheels may be used on sub-grade soil, granular material or cold mix to create additional density and find weak areas so they can be repaired before paving.

In order to provide desired compaction, different models of pneumatic compactors may include ballast blocks or tanks of various sizes that may be filled to provide desired ground contact pressure. For example, lightweight models may be utilized to create a tight bond when applied to chip and seal surfaces. Ballast may be created with steel, sand, or water.

SUMMARY

The disclosure describes, in one aspect, a compactor having a modular frame assembly. The modular frame assembly includes a first motive section, a second motive section, and a central ballast section. The first motive section includes at least one first wheel. The second motive section includes at least one second wheel. The central ballast section includes ballast. The ballast provides weight to the frame assembly to provide a desired compacting force. A first coupling arrangement secures the first motive section to the central ballast section. A second coupling arrangement secures the second motive section to the central ballast section.

The disclosure describes, in another aspect, a method of assembling a modular compactor. The method includes providing at least one central ballast section including ballast, providing a plurality of first motive sections including at least one first wheel and adapted to be assembled to the central ballast section, at least two of said first motive sections differing from one another, and providing a plurality of second motive sections including at least one second wheel and adapted to be assembled to the central ballast section, at least two of said second motive sections differing from one another. The method further includes coupling the first motive section to the central ballast section, and coupling the second motive section to the central ballast section.

BRIEF DESCRIPTION OF THE DRAWING(S)

DETAILED DESCRIPTION

Figure 1:
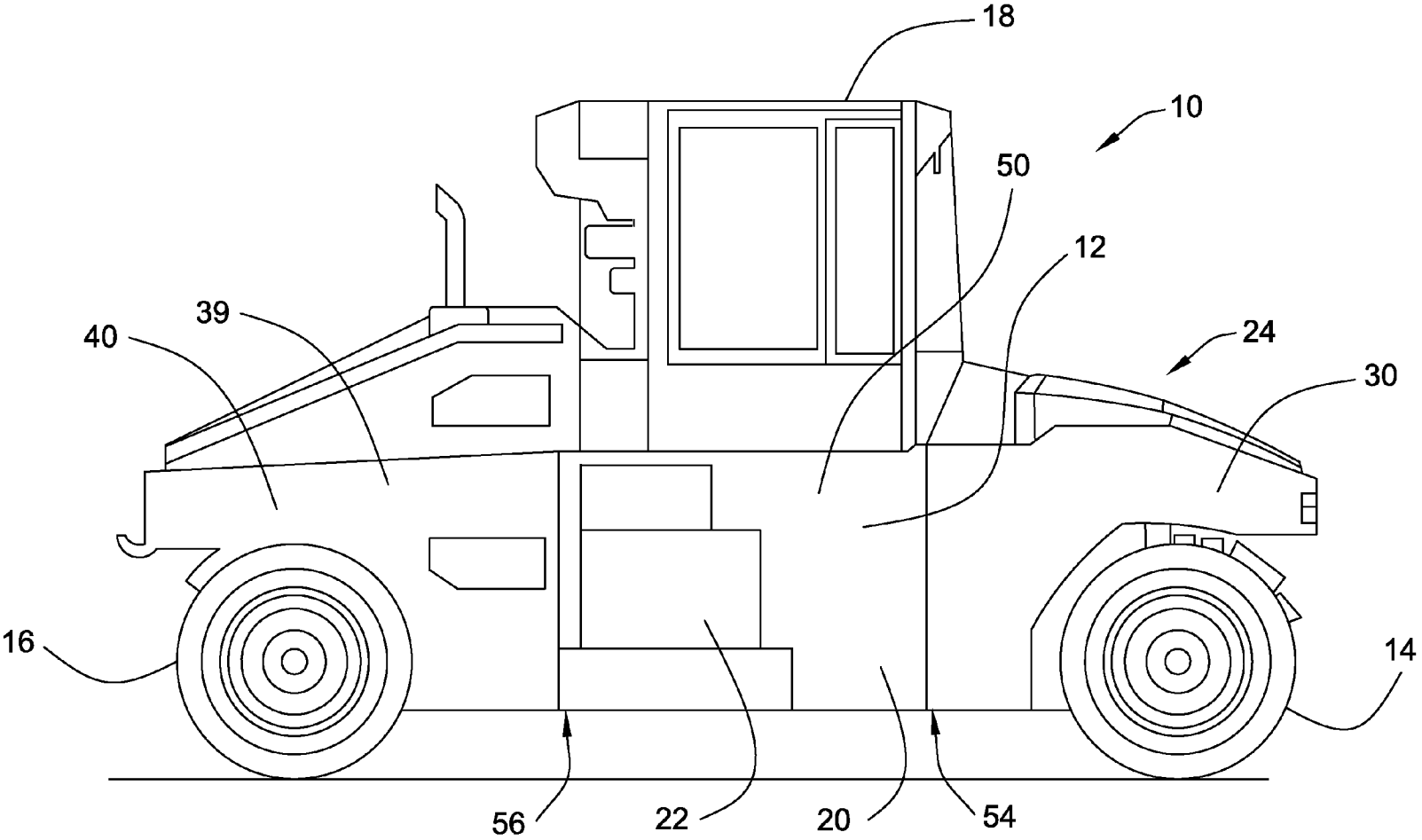
FIG. 1 is a side elevational view of a compactor in accordance with an embodiment.

This disclosure relates to a modular arrangement for construction of a frame assembly of a compactor. Referring now to the drawings, FIG. 1 shows an exemplary compactor 10, in accordance with an embodiment. The compactor 10 includes a chassis 12 supported by at least one first wheel 14 and at least one second wheel 16. In the embodiment illustrated in FIG. 1, the compactor 10 includes three first wheels and three second wheels. The chassis 12 includes a control station 18, ballast 22, and a drive arrangement 24 supported on a frame assembly 20.

In accordance with an aspect of this disclosure, the compactor 10 includes a frame assembly 20 that is of a modular construction. The frame assembly 20 includes a first motive section 30, a second motive section 40, and a central ballast section 50. According to one aspect of some embodiments, a plurality of first motive sections (see 32, 34, 36), as well as a plurality of second motive sections (see 42, 44, 46) may be provided, as illustrated, for example, in FIG. 2. In this way, a plurality of compactor 10 configurations may be provided based upon the application.

Each of the first and second motive sections 32, 34, 36, 42, 44, 46 includes at least one wheel 14, 16. In most embodiments, each of the first and second motive sections 32, 34, 36, 42, 44, 46 will each include a plurality of wheels 14, 16. In some embodiments the first and second motive sections 32, 34, 36, 42, 44, 46 will include three to six wheels 14, 16. For example, the illustrated first motive sections 32, 34, 36 include three, four, and five wheels 14, respectively. Similarly, the illustrated second motive sections 42, 46 include four wheels 16, while the second motive section 44 includes six wheels. Thus, it will be appreciated that the various first and second motive sections 32, 34, 36, 42, 44, 46 may include widths 38, 48, providing varied widths and coverage to the compactor 10 itself. While a plurality of wheels 14, 16 is illustrated for each of the first and second motive sections 32, 34, 36, 42, 44, 46, it will be appreciated that in alternate compactor designs, the at least one wheel 14, 16 may be in the form of a single roller on one or both of the first and second motive sections 32, 34, 36, 42, 44, 46.

The first motive section 32, 34, 36 may further include any appropriate steering mechanism 39. For example, first motive sections 32, 36 each include a bolster steering arrangement, while the first motive section 34 includes an Ackerman steering arrangement. As those of skill in the art will appreciate the construction and operation of each of these steering arrangements, they are not explained further in this disclosure.

The second motive section 42, 44, 46 may further include any appropriate drive arrangement 24. For example, second motive section 42 includes a longitudinally disposed engine, while the second motive sections 44, 46 include transversely disposed engines. Power from the engine may be transmitted by any appropriate arrangement. For example, second motive sections 42, 44 include gear box final drives, while second motive section 46 includes a sprocket chain drive.

The central ballast section 50 further includes ballast 22 and supports the control station 18. For the purposes of this disclosure, the term "ballast" will mean weight added to the compactor 10 to provide a desired force at the wheels 14, 16. That is, the ballast 22 is not merely the weight of required components of the compactor 10.

The ballast 22 may be of any appropriate form. By way of example only, the ballast 22 may be in the form of one or more blocks or tanks that may filled or partially filled with a fluid, such as water, or a solid material, such as sand. Alternatively or additionally, ballast 22 may include one or more ballast blocks formed of, for example, steel. In some embodiments, some ballast blocks or tanks may be fixedly installed on the frame assembly 20, while others of the ballast blocks or tanks may be removably installed. In this way, the ballast 22, and, therefore, the weight of the compactor 10 may be modified in order to suit a particular application.

It will be appreciated that features such as the steering mechanism 39 and the drive arrangement 24 need not be contained within or fully contained within the first and second motive sections 30, 40, respectively. For example, the drive arrangement 24 may be contained partially within one of the first or second motive sections 30, 40 and partially within the central ballast section 50. Moreover, ballast 22 may be contained in either or both of the first or second motive sections 30, 40, in addition to the ballast 22 within the central ballast section 50.

The first motive section 30 and the second motive section 40 are each coupled to the central ballast section 50 by any appropriate first and second coupling arrangements 54, 56. For example, they may be bolted, welded, or otherwise attached to one another so as to form the frame assembly 20 whereby the bolts or welds relative positions of the central ballast section 50 and the first and second motive sections 30, 40. The steering mechanism 39 of the first motive section 30 and the drive arrangement 24 of the second motive section 40 may then be connected to the central ballast section 50 such that they may be controlled from the supported control station 18.

The coupling may be facilitated by outside structure, such as plates that may be coupled to two or more of the first motive section 30, second motive section 40, and the central ballast section 50. Alternately, one or more of the first motive section 30, second motive section 40, and the central ballast section 50 may include structure to facilitate such coupling.

Figure 2:
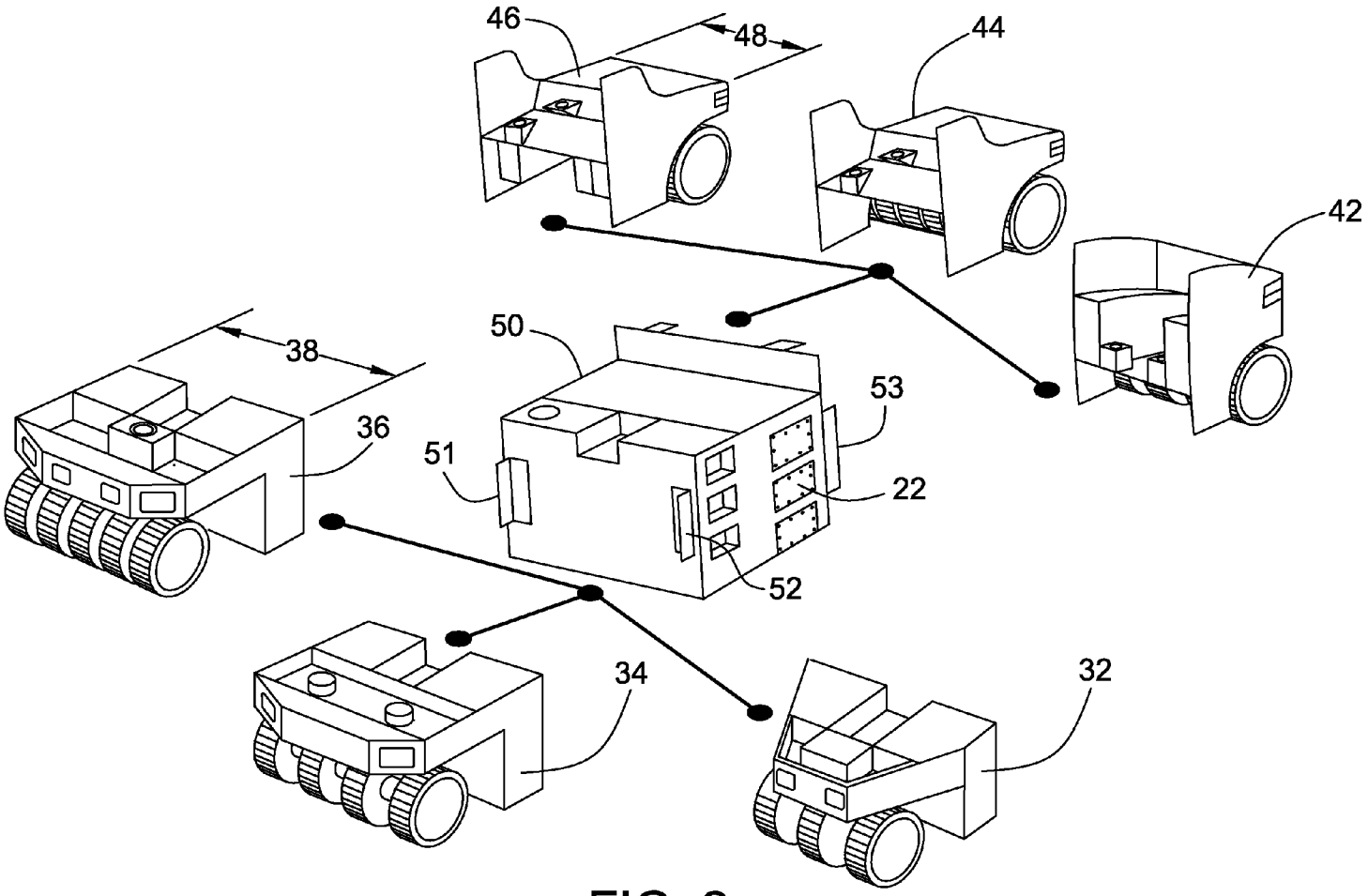
FIG. 2 is a schematic view of a modular frame arrangement including a plurality of front and rear section options.

In the embodiment illustrated in FIG. 2, the central ballast section 50 may include one or more flanges 51, 52, 53 that may be utilized to facilitate welding or bolting the first motive section 30, second motive section 40, and the central ballast section 50 together. By way of example only, flanges 51, 52 may be disposed against walls of the first motive section 30 and bolted or welded thereto. Welds may extend the entire length or less than the length of the flanges 51, 52, 53, or a plurality of welds may be provided along the flanges 51, 52, 53. It will further be appreciated that the first and second coupling arrangements may be the same or different.

INDUSTRIAL APPLICABILITY

The present disclosure is applicable to mobile compactors that include ballast to increase machine weight in order to provide a desired force at wheel surfaces contacting a surface. The disclosure is particularly applicable to pneumatic compactors 10.

It will be appreciated that the establishment of a plurality of unique, standardized first and second motive sections 30, 40 and one or more standardized central ballast sections 50, permits the construction of a plurality of frame assemblies 20 that are tailored to the particular customer machine requirements.

Some embodiments may provide a method of addressing the different machine configurations to meet application requirements of different markets. A frame assembly 20 may be constructed from a plurality of unique first and second motive sections 30, 40 along with a central ballast section 50.

By providing a number of standardized first and second motive sections 30, 40 along with one or more standardized central ballast sections 50, costs related to the construction and storage of multiple unique parts, that is, complete frames, may be minimized.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

I claim:

1. A method of assembling a modular compactor comprising:

providing a first central section, providing a second central section, providing a first front motive section having three wheels, providing a second front motive section having four wheels, providing a third front motive section having five wheels, providing a first rear motive section having four wheels, providing a second rear motive section having five wheels, providing a third rear motive section having six wheels, selecting a desired central section from the first central section and the second central section selecting a desired front motive section from the first front motive section, the second front motive section, and the third front motive section, coupling the desired front motive section to the desired central section, selecting a desired rear motive section from the first rear motive section, the second rear motive section, and the third rear motive section, and coupling the desired rear motive section to the desired central section.

2. The method of claim 1 further comprising:

providing a fourth front motive section having one wheel, two wheels, or six or more wheels, and selecting the desired front motive section from the first front motive section, the second front motive section, the third front motive section, and the fourth front motive section.

3. The method of claim 1 further comprising:

providing a fourth rear motive section having one wheel, two wheels, three wheels, or seven or more wheels, and selecting the desired rear motive section from the first rear motive section, the second rear motive section, the third rear motive section, and the fourth rear motive section.

4. A method of assembling a modular compactor comprising:

providing a first central section, providing a second central section, providing a first front motive section having a first number of wheels, providing a second front motive section having a second number of wheels, providing a first rear motive section having a third number of wheels, providing a second rear motive section having a fourth number of wheels, selecting a desired central section from the first central section and the second central section, selecting a desired front motive section from the first front motive section and the second front motive section, coupling the desired front motive section to the desired central section, selecting a desired rear motive section from the first rear motive section and the second rear motive section, and coupling the desired rear motive section to the desired central section, wherein the first number of wheels is different from the second number of wheels, and the third number of wheels is different from the fourth number of wheels, and wherein the first number of wheels is either three wheels, four wheels, or five wheels and the second number of wheels is either three wheels, four wheels, or five wheels.

5. The method of claim 4 wherein the third number of wheels is either four wheels, five wheels, or six wheels.

6. The method of claim 5 wherein the fourth number of wheels is either four wheels, five wheels, or six wheels.

7. The method of claim 4 wherein the first central section contains a first ballast arrangement.

8. The method of claim 7 wherein the second central section contains a second ballast arrangement.

9. A method of assembling a modular compactor comprising:

providing a first central section, providing a second central section, providing a first front motive section having a first number of wheels, providing a second front motive section having a second number of wheels, providing a first rear motive section having a third number of wheels, providing a second rear motive section having a fourth number of wheels, selecting a desired central section from the first central section and the second central section, selecting a desired front motive section from the first front motive section and the second front motive section, coupling the desired front motive section to the desired central section, selecting a desired rear motive section from the first rear motive section and the second rear motive section, and coupling the desired rear motive section to the desired central section, wherein the first number of wheels is different from the second number of wheels, and the third number of wheels is different from the fourth number of wheels, and wherein the third number of wheels is either four wheels, five wheels, or six wheels and the fourth number of wheels is either four wheels, five wheels, or six wheels.

* * * * *